US007654840B1

(12) United States Patent
Zapata et al.

(10) Patent No.: US 7,654,840 B1
(45) Date of Patent: Feb. 2, 2010

(54) DIMM CONNECTOR AND MEMORY SYSTEM WITH COMPENSATED AIRFLOW IMPEDANCE

(75) Inventors: Ivan R. Zapata, Cary, NC (US); Victor A. Stankevich, Cary, NC (US); Challis L. Purrington, Raleigh, NC (US); Henry G. McMillan, Raleigh, NC (US); Brian A. Baker, Raleigh, NC (US)

(73) Assignee: International Business Machines Corporation, Armonk, CA (US)

( * ) Notice: Subject to any disclaimer, the term of this patent is extended or adjusted under 35 U.S.C. 154(b) by 0 days.

(21) Appl. No.: 12/398,289

(22) Filed: Mar. 5, 2009

(51) Int. Cl.
*H01R 4/60* (2006.01)

(52) U.S. Cl. ..... 439/196; 439/485; 439/153; 439/327; 361/679.54; 361/690

(58) Field of Classification Search ..... 439/196, 439/485, 153, 327; 361/697.54, 690
See application file for complete search history.

(56) References Cited

U.S. PATENT DOCUMENTS 6,278,608 B1 8/2001 Ater et al.
6,483,699 B1 11/2002 Salmonson et al.
6,542,363 B2 4/2003 White
6,771,499 B2 8/2004 Crippen et al.
6,778,381 B1 * 8/2004 Bolognia et al. ..... 361/679.07
7,029,307 B1 * 4/2006 Ling et al. ..... 439/327
2007/0121286 A1 5/2007 Foster, Sr. et al.
2008/0101015 A1 5/2008 Peterson et al.

* cited by examiner

*Primary Examiner*—Tho D Ta
(74) *Attorney, Agent, or Firm*—Cynthia G. Seal; Jeffrey L. Streets

(57) ABSTRACT

An embodiment of the present invention is directed to a memory module connector having a pivotable air baffle that controls airflow at the memory module connector. When the memory module connector is occupied by a memory module, the air baffle may rest on an upper edge of the memory module, substantially parallel to the system board and in general alignment with the airflow. When the memory module has been removed, the air baffle may be pivoted downward toward the connector base and into the airflow, to offset the reduction in airflow impedance caused by the removal of the memory module from the memory module connector.

20 Claims, 3 Drawing Sheets

FIG. 1
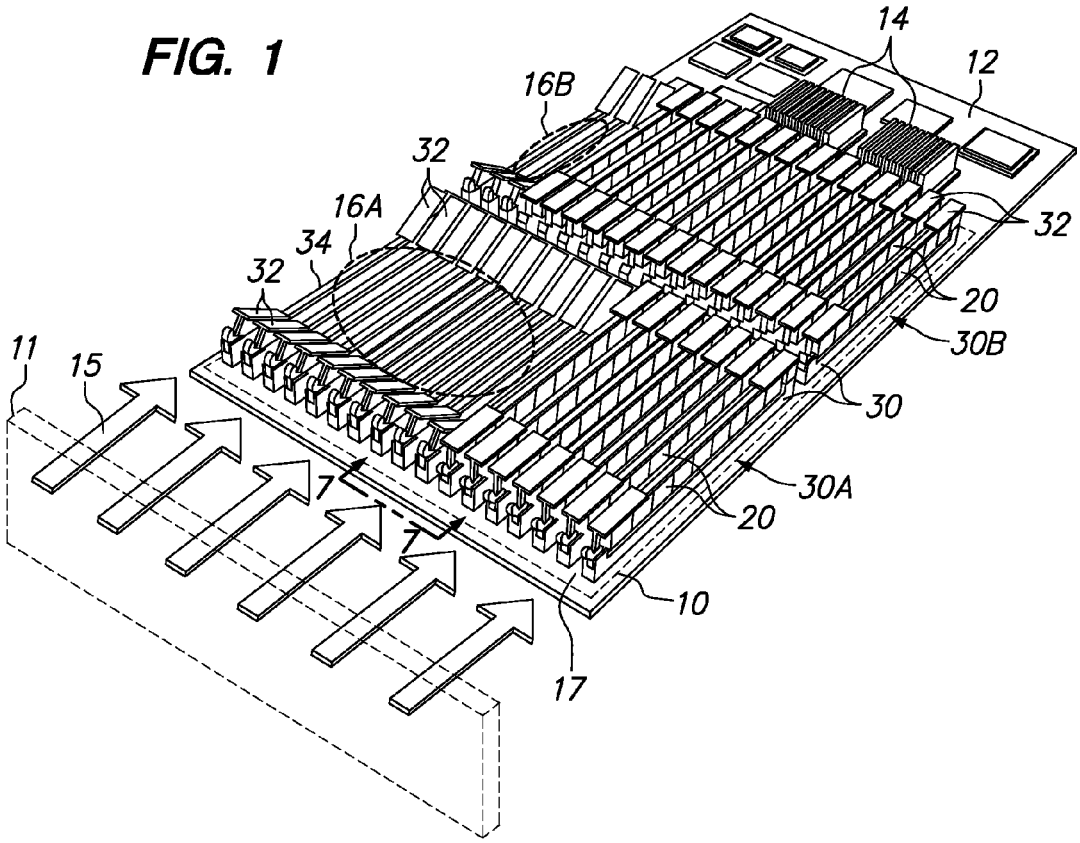
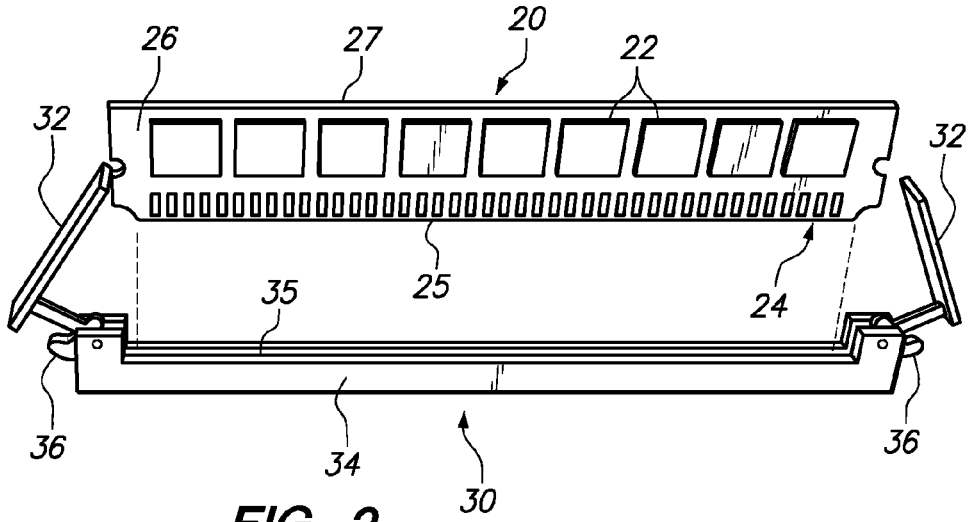
FIG. 2

DIMM CONNECTOR AND MEMORY SYSTEM WITH COMPENSATED AIRFLOW IMPEDANCE

BACKGROUND OF THE INVENTION

1. Field of the Invention

The present invention relates to memory module connectors in computer systems and controlling airflow to cool computer system components.

2. Background of the Related Art

In server systems, heat-generating electronic components are being packaged in increasingly dense enclosure configurations. Therefore, controlling and maintaining airflow for cooling has become vital to the optimal operation of these systems. Impedance to airflow within an enclosure caused by the presence of electrical and mechanical components poses a significant challenge to maintaining system operating temperatures within specification.

The need to control and maintain proper airflow is particularly applicable to main system memory, such as a dual in-line memory modules (DIMMs). DIMMs plug into DIMM connectors provided on the system board, which position the DIMMs perpendicular to or at a slight angle with the system board. DIMMs are usually grouped closely together and are oriented parallel to the airflow for optimum cooling and even airflow distribution.

BRIEF SUMMARY OF THE INVENTION

One embodiment of the present invention provides a memory module connector. The memory module connector includes a connector base securable in electronic communication with a circuit board. The connector base defines a slot for removably receiving a lower edge of a memory module. An air baffle is pivotably secured to the connector base and pivotable from a first position extending along an upper edge of the memory module when the memory module is received in the slot to a second position angled downwardly toward the connector base when the memory module is not received in the slot.

Another embodiment of the invention provides a computer system. The computer system includes a system board and a powered airflow source configured for generating airflow in a direction parallel to the system board. The computer system further includes a plurality of memory module connectors arranged along the circuit board for removably receiving a plurality of memory modules. The memory module connectors position the memory modules in a parallel, spaced-apart relationship and place the received memory modules in electronic communication with the system board. An air baffle is pivotably secured to an end of each memory module connector. The air baffle is pivotable from a first position parallel to the airflow when the memory module connector is occupied by a memory module to a second position extending downwardly toward the connector base when the memory module connector is not occupied by a memory module.

BRIEF DESCRIPTION OF THE SEVERAL VIEWS OF THE DRAWINGS

FIG. 1 is a perspective view of a section of a system board that includes a memory system according to an embodiment of the invention.

FIG. 2 is a partially-exploded perspective view of a DIMM and DIMM connector from the memory system of FIG. 1.

DETAILED DESCRIPTION OF THE INVENTION

Figure 3:
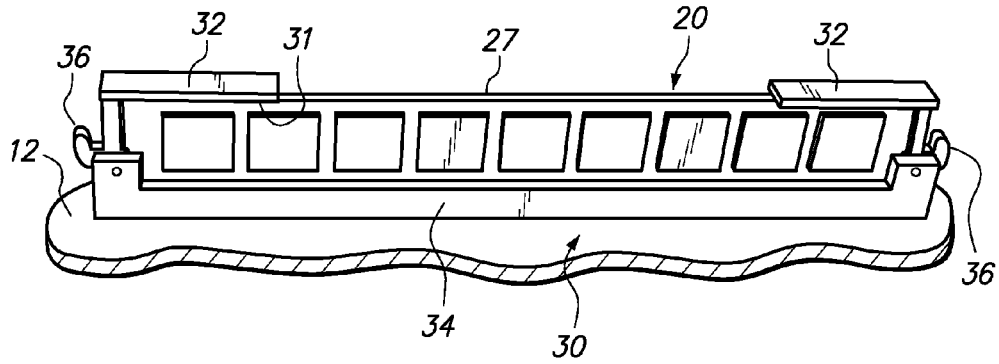
FIG. 3 is a perspective view of a DIMM connector occupied by a DIMM.

An embodiment of the present invention is directed to a memory module connector having a pivotable air baffle that controls airflow at the memory module connector. When the memory module connector is occupied by a memory module, the air baffle may rest on an upper edge of the memory module in a position of minimal airflow impedance, substantially parallel to the system board and in general alignment with the airflow. When the memory module has been removed, the air baffle may be pivoted downward to a position of increased airflow impedance, with the air baffle angled toward the connector base and into the airflow, to offset the reduction in airflow impedance caused by the removal of the memory module from the memory module connector. The air baffle compensates for areas of reduced airflow impedance that would otherwise be present in populated regions of a memory system. Individually compensating for airflow impedance at the memory module connectors promotes a more uniform distribution of airflow and more reliable cooling of computer system components.

The dimensions of the air baffle may be selected so that substantially the same airflow impedance is presented by an unoccupied memory module (memory module removed, air baffle pivoted down) and an occupied memory module connector (memory module plugged-in, air baffle parallel to system board). Thus, airflow impedance remains fairly constant across a group of spaced-apart memory module connectors, even if some of the memory module connectors are unoccupied. Airflow to components downstream of the memory module connectors is therefore unaffected by the absence of a memory module in one or more of the memory module connectors.

The memory modules and memory module connectors in the following embodiments are DIMMs and DIMM connectors, which are currently the prevalent type of card-based memory module in the computer arts. One skilled in the art will appreciate, however, that aspects of the embodiments discussed herein may be used with other existing and future-developed types of memory modules and memory module connectors, and that the invention is not limited to use specifically with DIMMs. One skilled in the art will further appreciate that aspects of the embodiments discussed herein may also be used, more generally, with other types of electronic device cards used in computer systems.

FIG. 1 is a perspective view of a section of a system board 12 that includes a memory system 10 according to an embodiment of the invention. The system board 12, which may be alternatively referred to as a "motherboard" or "main board," is the primary printed circuit board (PCB) of a computer, such as a blade server. The memory system 10 serves as primary storage for the system board 12, accessible by a central processing unit (CPU, not shown) for reading and executing instructions stored therein. The system board 12 also includes other components, such as one or more microprocessors, controllers for video display and sound, and peripheral devices that may either be connected to the system board 12 as removable, plug-in device cards or integrated with the system board 12.

The memory system 10 includes, by way of example, thirty-four DIMM connectors 30 arranged in two rows 30A, 30B on the system board 12. Each DIMM connector 30 may receive one DIMM 20, giving the memory system 10 a capacity of up to thirty-four DIMMs 20. However, the system board 12 may be configured with less than the maximum memory capacity, with fewer than all thirty-four DIMM connectors 30 receiving a DIMM 20. For example, the memory system 10 of FIG. 1 currently includes an unpopulated region 16A in the first row 30A with ten unoccupied DIMM connectors 30, and an unpopulated region 16B in the second row 30B with three unoccupied DIMM connectors 30.

The DIMM connectors 30 mechanically secure the DIMMs 20 at an angle to the system board 12, which in this embodiment is at a right angle (i.e. perpendicular) to the system board 12. The DIMM connectors 30 in each row 30A, 30B are evenly spaced and arranged to position the DIMMs 20 in a parallel, spaced-apart relationship. A powered airflow source 11, which may include one or more fan or blower, generates airflow 15 by forced convection in a direction parallel to the system board 12 to cool the DIMMs 20 and various other heat-generating system components. The parallel, spaced-apart relationship of the DIMMs 20 and the perpendicular positioning of the DIMMs 20 relative to the system board 12 allows airflow to the memory system 10 to flow between the DIMMs 20 for cooling the DIMMs 20. Some of the airflow between the DIMMs 20 then flows to a pair of downstream heatsinks 14 to cool components, such as a CPU, in direct thermal contact with the heatsinks 14. It should be recognized that fans or blowers may be part of the same or different chassis as the system board, and may be positioned to the front or the rear of the system board, so long as air is drawn across the DIMM connectors.

The parallel, evenly-spaced positioning of the DIMM connectors 30 does not, alone, guarantee an even distribution of the airflow 15 among the DIMMs 20. To help maintain a uniform airflow distribution, the DIMM connectors 30 in the memory system 10 each further include two opposing air baffles 32 pivotally coupled to the connector base 34 of each DIMM connector 30. When the DIMM connector 30 is occupied by a DIMM 20, the air baffles 32 are in a position of least airflow impedance (alternately referred to herein as the "first position"), aligned with the direction of the airflow 15. When the DIMM connector 30 is unoccupied (e.g. when the DIMM 20 is removed), the air baffles 32 may be pivoted to a position of increased airflow impedance (alternately referred to herein as the "second position"), which position may be directed downward at an angle to the airflow 15. The downward angling of the air baffles 32 of the unoccupied DIMM connectors 30 increases the impedance presented by the air baffle 32 to the airflow 15, in order to offset a reduction in airflow impedance caused by the absence of a DIMM in the unoccupied DIMM connectors 30 in region 16A. As a result, each unoccupied DIMM connector 30 desirably presents substantially the same airflow impedance as if a DIMM 20 were received in the DIMM connector 30. The air baffles 32 thereby equalize airflow impedance of DIMM connectors 30 along the rows 30A, 30B. This equalization of airflow impedance and correspondingly even distribution of airflow among the DIMM connectors 30 prevents an increased airflow rate (i.e. "air channeling") at the unpopulated regions 16A, 16B due to the absence of DIMMs. Such air channeling would otherwise reduce airflow to the DIMMs 20 and divert much of the airflow around the downstream heatsinks 14 through, for example, region 16B. Thus, ample airflow is maintained to all of the DIMMs 20 and to the downstream heatsinks 14 for proper cooling of these components.

FIG. 2 is a partially-exploded perspective view of a DIMM 20 and DIMM connector 30 from the memory system 12 of FIG. 1. Two air baffles 32 are included with the DIMM connector 30 in this embodiment, with one of the air baffles 32 pivotably coupled to one end of the connector base 34 and another air baffle 32 pivotably coupled to an opposing end of the connector base 34. The air baffles 32 are shown in an outwardly pivoted, upwardly-angled position that allows for the axial insertion and removal of the DIMM 20 into the slot 35 of the connector base 34, unobstructed by the air baffles 32. While two air baffles 32 are included in the DIMM connector 30, another embodiment may include just one air baffle.

The DIMM 20, itself, may be a conventional DIMM known in the art. As understood in the art, the DIMM 20 includes a plurality of (e.g. nine) "DRAM" memory chips 22 per side of a substrate 26, and a plurality of (e.g. seventy-two) electrical terminals 24 along a card edge 25 of the DIMM 20. The electrical terminals 24 along the card edge 25 are electrically coupled to electrical terminals of the memory chips 22 along internal communication pathways on the wafer substrate 26. A slot 35 in the connector base 34 of the DIMM connector 30 is configured to frictionally receive the card edge 25 of the DIMM 20. Friction between the card edge 25 of the DIMM 20 and the slot 35 of the connector base 34 helps retain the DIMM 20 when frictionally received by the slot 35. The electrical terminals 24 are arranged to make electrical contact with corresponding electrical terminals (not shown) inside the slot 35. As generally understood in the art, a memory controller (not shown) communicates with the DIMMs 20 to read and write to selected memory chips 22 of the DIMM 20 using input/output (I/O) signals in combination with chip select (CS) signals.

A latch 36 is included at each end of the connector base 34. Although friction may be sufficient to retain the DIMM 20 in the slot 35, the latches 36 are optionally provided to lock the DIMM 20 in the slot 35. In particular, the latches 36 may include any of a variety of locking mechanisms generally known in the art for the purpose of securing a DIMM against removal from the base of a DIMM connector. Pivoting the latches 36 inward may activate such a locking mechanism to secure the DIMM 20, and pivoting the latches 36 back outward may release the DIMM 20. Optionally, the axial force of inserting the DIMM 20 into the slot 35 may actuate the latches 36 to lock the DIMM 20 in the slot 35, and an outward force may be applied to the latches 36 to subsequently release the DIMM 20.

FIG. 3 is a perspective view of a DIMM connector 30 occupied by a DIMM 20. The latches 36 are pivoted inward with respect to their position in FIG. 2, to lock the DIMM 20 in the DIMM connector 30. The air baffles 32 are in the position of minimal airflow impedance, in contact with or in close proximity to an upper edge 27 of the DIMM 20. This positioning of the air baffles 32 orients the air baffles 32 substantially parallel to the connector base 34 and to the system board 12, and in general alignment with the direction of the airflow 15 (See FIG. 1), to minimize any airflow impedance presented to the airflow by the air baffles 32. Thus, airflow may travel between the lower surface 31 of the air baffles 32 and the system board 12, with minimal interference by the air baffles 32. The air baffles 32 do not substantially increase the overall height of the memory system 10 when positioned against the upper edge 27 of the DIMM 20 as in FIG. 3.

The air baffle 32 and latch 36 at each end of the connector base 34 may be coupled or integrated with one another, such that the action of pivoting the integrated latch 36 and air baffle 32 may secure the DIMM 20 in the connector base 34 while simultaneously moving the air baffle 32 to a horizontal position parallel with the airflow and the system board 12. The air baffles 32 and latches 36 may alternatively be secured to the connector base 34 in a manner that allows the air baffles 32 and latches 36 to pivot independently of one another, such that pivoting the latches 36 inward to lock the DIMM 20 and pivoting the air baffles 32 inward may be performed separately and as two distinct actions.

In addition to the locking mechanism provided by the latches 36, the air baffles 32 may further secure the inserted DIMM 20 when the air baffles are pivoted into engagement with the upper edge 27 of the DIMM 20. Thus, although the DIMM 20 may be secured against removal from the slot 35 predominantly by the latches 36, the air baffles 32 may also help secure the DIMM 20 in the slot because they interfere with the removal of the DIMM 20 from the slot 35 when the air baffles 32 are in the position of FIG. 3. In another embodiment, the air baffles 32, alone, may act as latches to secure the DIMM against removal from the slot 35, and the latches 36 may be omitted.

Figure 4:
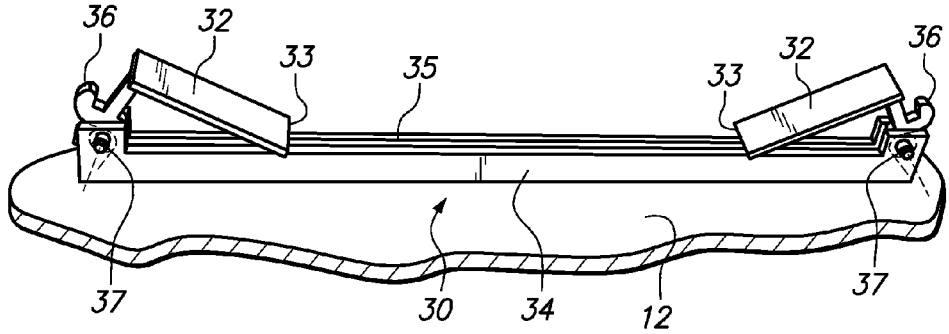
FIG. 4 is a perspective view of an unoccupied DIMM connector.

FIG. 4 is a perspective view of an unoccupied DIMM connector 30, such as from one of the unpopulated regions 16A or 16B of FIG. 1. The absence of any DIMM in the slot 35 allows the air baffles 32 to be pivoted to the position of increased airflow impedance, oriented downwardly toward the connector base 34 and toward the system board 12. A spring 37 is optionally provided to bias the latches 36 and/or the air baffles 32 inwardly to their illustrated positions. This biasing action of the spring 37 may retain the air baffle 32 in the illustrated position during use, shipment, or transport of the system board 12. In this embodiment, a leading edge 33 of each air baffle 32 contacts the connector base 34, to minimize or prevent any airflow from passing between the air baffle 32 and the connector base 34. In another embodiment, the air baffles may be angled downward toward the connector base 34 but without physically contacting the connector base 34.

Figure 5:
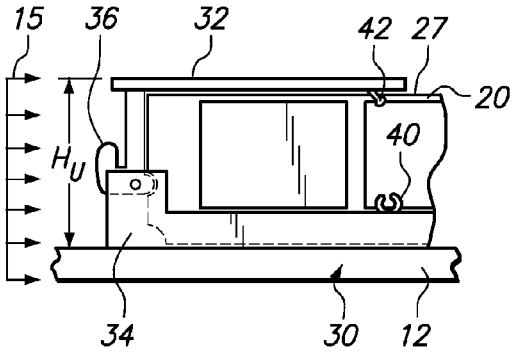
FIG. 5 is a side view of the occupied DIMM connector and DIMM of FIG. 3 with the air baffles in the position of minimal airflow impedance.

FIG. 5 is a side view of the occupied DIMM connector 30 and DIMM 20 of FIG. 3, with the air baffles 32 in the position of minimal airflow impedance. The latch 36 is pivoted inward to lock the DIMM 20 in the DIMM connector 30. The air baffle 32 is in a horizontal position extending along the upper edge 27 of the DIMM 20, parallel to the direction of the airflow 15. The overall height of the DIMM connector 30, DIMM 20, and air baffle 32 is labeled "$H_U$." The thickness of the air baffle 32 contributes only a small amount to the overall height $H_U$. The air baffle 32 presents very little airflow impedance to the airflow 15 in this position. An optional retention mechanism includes, by way of example, a female retainer member 40 provided on the connector base 34 and a male retainer member 42 provided on the air baffle 32. The female retainer member 40 and male retainer member 42 are configured to "snap together" when the air baffle 32 is subsequently pivoted downward. In the position of the air baffle 32 of FIG. 5, the female and male retainer members 40, 42 are currently separated.

Figure 6:
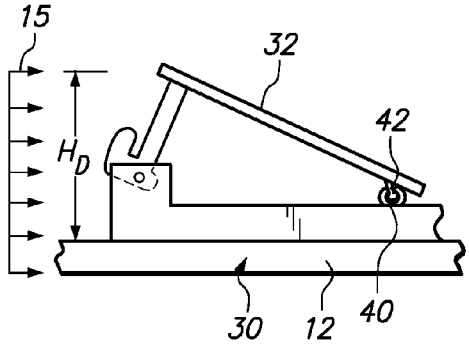
FIG. 6 is a side view of the unoccupied DIMM connector of FIG. 4, with the air baffles in the position of increased airflow impedance.

FIG. 6 is a side view of the unoccupied DIMM connector 30 of FIG. 4, with the air baffles 32 in the position of increased airflow impedance. The air baffle 32 is pivoted downward toward the connector base 34 and the system board 12, at an angle to the airflow 15. The face of the air baffle 32 incident to the airflow 15 increases the impedance to the airflow 15 to compensate for the absence of a DIMM in the unoccupied DIMM connector 30. The increase in airflow impedance presented by the baffle 32 in its position of FIG. 6 may be substantially equal to the amount of airflow impedance presented by the DIMM 20 in the occupied DIMM connector 30 of FIG. 5. The overall height HD of the unoccupied DIMM connector of FIG. 6 may be approximately equal to the overall height $H_U$ of the DIMM connector 30, DIMM 20, and air baffle 32 of FIG. 5.

Moving the air baffle 32 from its position of FIG. 5 to its position of FIG. 6 moves the male retainer member 42 into the female retainer member 40. The female and male retainer members 40, 42 have an interference fit that causes the female and male retainer members 40, 42 to "snap together," which is useful to retain the air baffle 32 in the downward position of FIG. 6 during use, transport, or shipment of the system board 12. Either or both of the optional spring 37 of FIG. 4 and the optional retention mechanism of FIGS. 5 and 6 may be included with the DIMM connector 30 to maintain the air baffle 32 in the position of FIG. 6.

Figure 7:
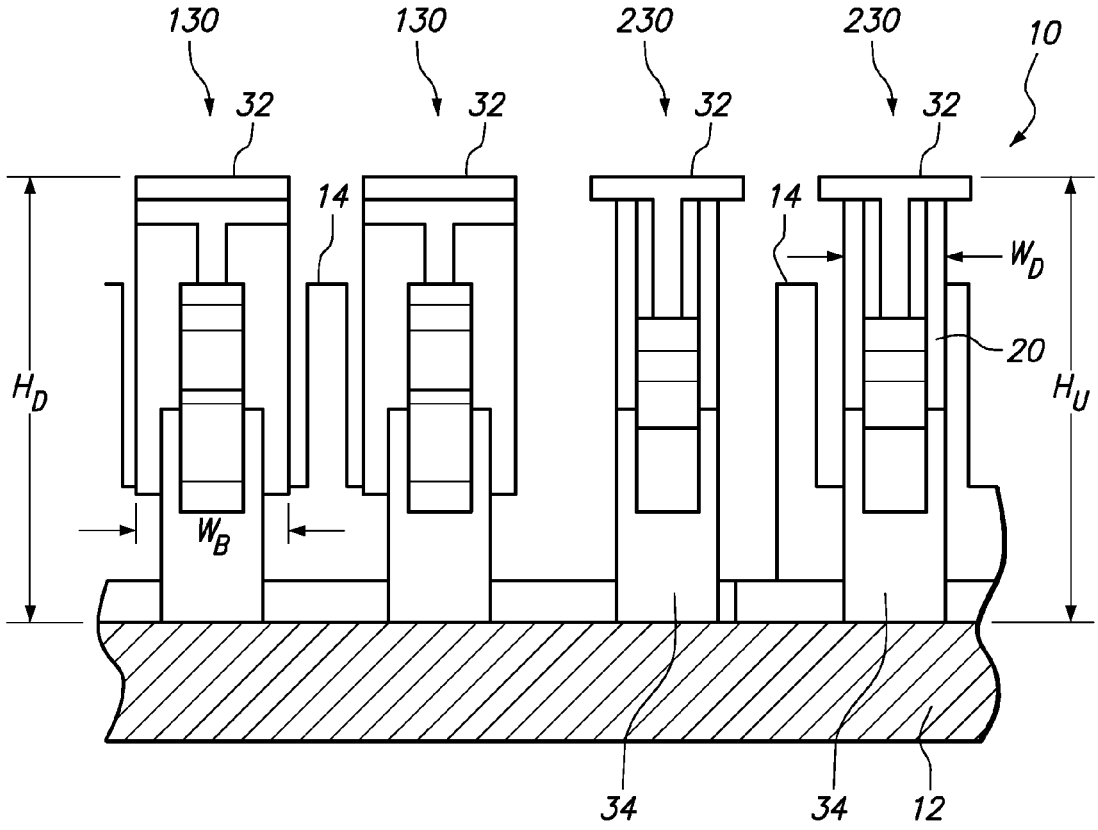
FIG. 7 is a front elevation view of four consecutive DIMM connectors of the memory system as taken along section line 7-7 of FIG. 1

FIG. 7 is a front elevation view of four consecutive DIMM connectors of the memory system 10 as taken along section line 7-7 of FIG. 1. This view includes two unoccupied DIMM connectors 130 on the left and two occupied DIMM connectors 230 on the right, with all four DIMM connectors 130, 230 evenly spaced and perpendicular to the system board 12. The heatsinks 14 are visible behind the four DIMM connectors 130, 230. The airflow baffles 132 in each occupied DIMM connector 230 are each at a position of minimum airflow impedance (see also FIG. 5), which is parallel to the system board 12 (into the page). The airflow baffles 32 in each unoccupied DIMM connector 130 are each pivoted downward toward the connector base 34, at a position of increased airflow impedance (see also FIG. 6) relative to FIG. 5.

The width $W_B$ of the air baffle 32 is similar to (but is not required to be the same as) the width $W_D$ of the DIMM 20. To closely match the airflow impedance of each unoccupied DIMM connector 130 to the airflow impedance of each occupied DIMM connector 230, the width $W_B$ of the angled air baffle 32 may be chosen to be slightly greater than the width $W_D$ of the DIMM 20, as shown. The dimensions of the air baffle 32 may be chosen such that the vertical projected area (in the plane of FIG. 7) of one of the unoccupied DIMM connectors 130 is similar to the vertical projected area of one of the occupied DIMM connectors 230. However, due to minor differences in form factor of the unoccupied DIMM connectors 130 and occupied DIMM connectors 230, the dimensions of the air baffle 32 that most closely match the airflow impedance of the unoccupied DIMM connector 130 with the occupied DIMM connector 230 may be empirically determined (e.g. using an experimental test fixture) or theoretically derived (e.g. using computational fluid dynamics).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A memory module connector, comprising:

a connector base securable in electronic communication with a circuit board, the connector base defining a slot for removably receiving a lower edge of a memory module; and an air baffle pivotably secured to the connector base and pivotable from a first position extending along an upper edge of the memory module when the memory module is received in the slot to a second position angled downwardly toward the connector base when the memory module is not received in the slot.

2. The memory module connector of claim 1, wherein the width of the air baffle is equal to or greater than a width of the memory module.

3. The memory module connector of claim 1, further comprising a biasing member for biasing the air baffle to the second position.

4. The memory module connector of claim 1, further comprising a retention member for releasably retaining the air baffle in the second position.

5. The memory module connector of claim 1, further comprising a latch movable to a locked position for releasably locking the memory module to the connector base.

6. The memory module connector of claim 5, wherein the latch and air baffle are integrated such that movement of the air baffle from the second position to the first position moves the latch to the locked position.

7. The memory module connector of claim 1, wherein the air baffle is movable to a third position outwardly pivoted from the first position providing clearance for axial insertion and removal of the memory module from the slot.

8. The memory module connector of claim 7, wherein the air baffle is movable from the third position to the first position but not to the second position while the memory module is in the slot.

9. The memory module connector claim 1, wherein the air baffle contacts the connector base in the second position.

10. A computer system, comprising:

a system board;

a powered airflow source configured for generating airflow in a direction parallel to the system board;

a plurality of memory module connectors arranged along the circuit board for removably receiving a plurality of memory modules to position the memory modules in a parallel, spaced-apart relationship and to place the received memory modules in electronic communication with the system board; and an air baffle pivotably secured to an end of each memory module connector and pivotable from a first position parallel to the airflow when the memory module connector is occupied by a memory module to a second position extending downwardly toward the connector base when the memory module connector is not occupied by a memory module.

11. The computer system of claim 10, wherein the air baffle engages an upper edge of the memory module in the first position.

12. The computer system of claim 11, wherein the air baffle secures the memory module against removal from the memory module connector in the first position.

13. The computer system of claim 12, wherein the air baffle is pivotable to a third position wherein the memory module is axially removable from the memory module connector unobstructed by the air baffle.

14. The computer system of claim 10, further comprising a biasing member for biasing the air baffle toward the second position.

15. The computer system of claim 10, further comprising a retention member for releasably retaining the air baffle in the second position.

16. The computer system of claim 10, further comprising a latch movable to a locked position for releasably locking the memory module to the connector base.

17. The computer system of claim 16, wherein the latch and air baffle are coupled or integrated such that movement of the air baffle from the second position to the first position moves the latch to the locked position.

18. The computer system of claim 11, wherein the air baffle is movable to a third position outwardly pivoted from the first position and providing clearance for axial insertion and removal of the memory module from the slot.

19. The computer system of claim 18, wherein the air baffle is movable from the third position to the first position but not to the second position while the memory module is in the slot.

20. The computer system of claim 10, wherein the air baffle contacts the connector base in the second position.

* * * * *